United States Patent [19]

Strange et al.

[11] 4,120,345

[45] Oct. 17, 1978

[54] METHOD FOR INGOT MOLD REPAIR

[75] Inventors: Robert R. Strange, Northfield, Ohio; James M. Zimmer, Brighton Township, Beaver County, Pa.

[73] Assignee: Crucible Inc, Pittsburgh, Pa.

[21] Appl. No.: 848,046

[22] Filed: Nov. 3, 1977

Related U.S. Application Data

[63] Continuation-in-part of Ser. No. 784,769, Apr. 5, 1977, abandoned.

[51] Int. Cl.[2] ..... B22D 7/06; B22D 19/10

[52] U.S. Cl. ..... 164/92; 164/121; 249/174; 29/401 E

[58] Field of Search ..... 164/54, 72, 80, 92, 164/121; 249/174; 29/401 R, 401 E

[56] References Cited

U.S. PATENT DOCUMENTS 3,920,948 11/1975 Schokkenbroek ..... 29/401 R X

FOREIGN PATENT DOCUMENTS 274,862 3/1964 Australia ..... 164/92

*Primary Examiner*—Francis S. Husar
*Assistant Examiner*—John S. Brown

[57] ABSTRACT

A method for ingot casting using a vertical, open-ended mold removably positioned on a mold stool, a closed-bottom mold or a plug-bottom mold wherein steel particles are used to fill a relieved portion of the bottom typically resulting from erosion thereof during casting; a metal plate is used to close this relieved portion, thereby preventing comingling of the steel particles and metal being cast; this practice prolongs the life of mold stools and mold bottoms without requiring expensive replacement.

5 Claims, 2 Drawing Figures

METHOD FOR INGOT MOLD REPAIR

This application is a continuation-in-part of copending application Ser. No. 784,769, filed Apr. 5, 1977 and now abandoned.

In the production of various high-strength alloy steels, tool steels and some superalloys it is conventional practice to melt in an electric furnace and from the electric furnace melt produce castings. The castings are then subsequently used as an electrode for further refining of the alloy by vacuum consumable arc melting thereof. In the casting operation the molten metal from a transport ladle is cast into a plurality of open-ended molds which are removably positioned on mold stools, with the mold stool closing the bottom end of the mold in preparation for casting. Upon solidification of the cast metal, the mold is lifted vertically to slide it from the casting, and the casting is thereafter removed from the mold stool for further processing, such as by vacuum arc melting for further refining.

During the casting operation the stream of molten metal from the ladle initially strikes the mold stool at the bottom of the mold and after repeated operations causes erosion of the mold stool surface. This results in the mold stool having a relieved portion on its surface area surrounded by the mold. As a result of this erosion the mold stools must either be frequently replaced or reconditioned which adds significantly to the cost of the casting operation. Otherwise the molten metal being cast will solidify in the relieved portion of the mold stool to form a protruding knob on the bottom of the casting. This knob must be removed as a step in preparing the casting for further processing, as by the use of the casting as an electrode in vacuum arc melting. This removal of the knob reduces the product yield. This problem with mold stools, which is caused by erosion during casting, also results with closed-bottom and plug-bottom molds.

It is accordingly an object of the present invention to provide an ingot casting method whereby the relieved portion of the mold stool or mold bottom resulting from erosion during casting may be efficiently repaired for each casting operation, thereby increasing product yield and adding significantly to the life of the mold stool or mold bottom.

Figure 1:
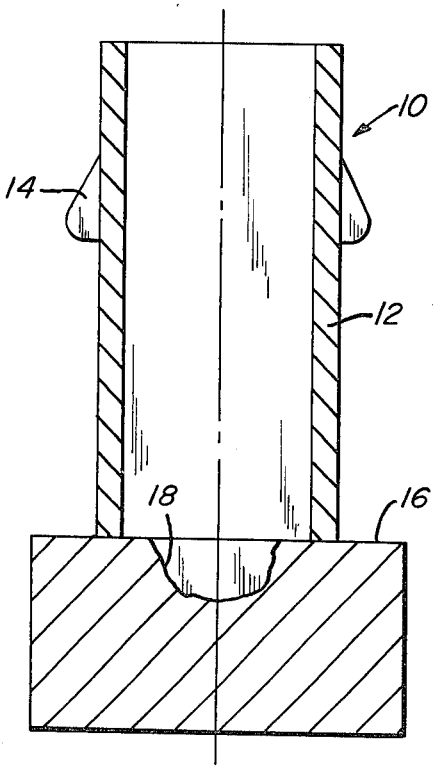
Figure 2:
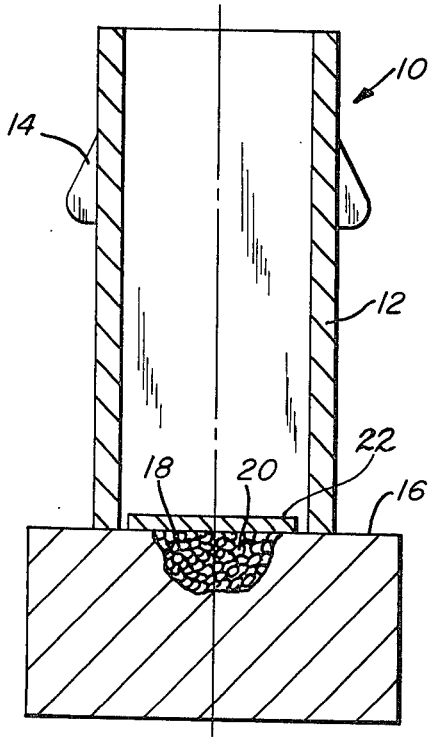

This and other objects of the invention as well as a more complete understanding thereof may be obtained from the following description and drawings, in which:

FIG. 1 is a schematic showing of an open-ended ingot mold positioned on a mold stool having a relieved portion on the surface thereof resulting from erosion during casting; and FIG. 2 is a schematic showing similar to that of FIG. 1 wherein one embodiment of the invention is shown.

Broadly, in the practice of the invention, prior to the casting operation the relieved portion of the mold stool is filled with metal particles, preferably steel shot, and thereafter the relieved portion of the mold stool is covered with a plate. Consequently, during casting the molten metal is essentially prevented from entering the relieved portion of the mold stool and the particles do not significantly comingle with the molten metal during casting. Comingling of the metal particles to a significant extent would cause the bottom comingled portion of the casting to be of an unsatisfactory composition requiring removal and scrapping thereof prior to further processing of the ingot as by consumable electrode melting. For the purpose at least one metal plate, preferably steel, is placed over the relieved portion of the mold stool and within the surface area thereof enclosed by the mold. Preferably the plate has a specific gravity at least equal to that of the metal being cast to prevent the plate from floating in the metal being cast prior to solidifiifation of the metal. In this manner, after solidification and removal of the mold from the ingot casting it is not necessary to remove any significant portion of the casting bottom to ready the casting for use as an electrode in subsequent vacuum arc melting operations. In the conventional practice wherein the casting bottom was characterized by a protruding knob resulting from the metal solidified in the relieved portion of the mold stool it was necessary, prior to using the ingot in vacuum arc melting, to remove this protruding knob along with significant portions of the usable body of the ingot casting. The removal of this cast material significantly decreased the product yield of each casting.

Any portion of the metal cover plate and steel shot adhering to the casting bottom need not be removed prior to use of the ingot casting as an electrode for vacuum arc melting. Characteristic of the vacuum arc melting practice, there is provided in the bottom of the vacuum arc furnace a quantity of starter material in the form of machined chips and turnings. This material is used so that during the initial production of the arc from the electrode bottom the furnace bottom is protected from deterioration resulting from the burning action of the arc. For purposes of achieving a homogeneous vacuum arc melting ingot structure the initial portion of the vacuum arc melt, constituting the striker chips and the initial vacuum arc melted material combining therewith is discarded. This discard results from the conventional cropping operation imparted to the end of the workpiece produced from the vacuum arc melted ingot during subsequent operations such as forging or rolling. It may be seen, therefore, that with the practice of the invention not only do savings result from the standpoint of increased product yield and prolonged mold stool life but in addition there is no special preparation, such as a cropping action, necessary to remove any significant amount of metal from the bottom of the ingot prior to vacuum arc melting. The only operation necessary to ready the ingot for use as an electrode in vacuum arc melting is the prior practice of subjecting it to a lathe-turning operation in which a concentric surface portion is removed and a longitudinal taper imparted to the ingot casting.

With reference to the drawings, FIG. 1 shows an assembly 10 including a vertical open-ended ingot mold 12 having side lugs 14 to facilitate removal and transport, as by the use of an overhead crane. In typical preparation for an ingot casting operation the mold 12 is shown positioned on a mold stool 16, which mold stool has a relieved portion 18 caused by erosion during casting. With this relieved portion being present, after casting and upon solidification molten metal will form a protruding knob on the bottom of the casting. This knob must be removed prior to using the casting as an electrode in vacuum arc melting. This of course significantly detracts from the product yield and overall efficiency of the operation. FIG. 2 shows the identical structure of FIG. 1 with the relieved portion 18 of the mold stool filled with steel shot 20 and with the relieved portion then covered with a steel plate 22. The shot 20 effectively repairs the relieved portion for the casting operation, thereby preventing the formation of undesirable protruding knobs and the plate 22 prevents comingling of the steel shot 20 with the molten metal being cast. The shot 20 during casting and as a result of the heat from the cast meal fuses together and to the surface of the relieved portion or cavity to fill the same. If significant comingling is permitted the comingled portion of the ingot casting will not be of the required composition, and thus removal of this portion will be required before further processing.

Prior to the use of the invention, conventional mold stools used in the production of electric furnace melted high strength alloy steels required replacement after about 8 to 10 castings, and all of the castings prior to use as electrodes in vacuum arc melting operations required that the bottoms thereof be trimmed by torch cutting to remove the protrusion caused by metal entering the relieved portion of the mold stool. By the use of conventional steel shot of the typical composition 0.9% carbon, 0.9% silicon, 0.75% manganese and balance iron with metal plates covering the eroded portion of the mold stool 26 castings have been made in accordance with the invention with the same stools with no additional detechable erosion. Initially, and prior to the use of the invention, the stools contained cavities ranging from 1 to 7 inches in depth. By the use of steel shot within the relieved portion of the mold stool covered with a steel plate in accordance with the practice of the invention, the molten metal quickly solidified without entering the relieved portion of the mold and comingling with the shot. Hence, product yield is maximized and the life of the mold stool is prolonged.

It has been found that if the steel shot is nonuniform in size, the shot will sinter together during the casting operation to fill, at least partially the relieved portion and will not be pulled from the mold stool with the casting upon lifting of the solidified casting therefrom. Hence it is preferred in the practice of the invention that the shot be of a nonuniform size of for example −8 to +70 mesh U.S. Standard.

Although the invention has been described as used in the manufacture of ingot castings for subsequent use as electrodes in vacuum arc melting operations, the invention is useful in any casting operation wherein erosion of the mold stool or mold bottom is encountered and by using the invention increased product yield and increase stool life result.

Although the invention has been described as being used with mold stools having relieved surface portions caused by erosion during casting, nevertheless the invention would also find utility with mold stools and mold bottoms initially constructed with cast surface cavities. In this instance, the invention could be used during the initial castings with mold stools of this type.

The term mold bottom as used herein refers to mold stools and mold bottoms of both the integral and plug-bottom type.

We claim:

1. In a method for ingot casting using a vertical mold having a mold bottom with a relieved portion produced by erosion during casting, which method includes the steps of casting molten metal into said mold to form a casting upon solidification of said molten metal and removal of said solidified casting from said mold, the improvement comprising, prior to casting, essentially filling said relieved portion with metal particles only and covering said relieved portion with a plate, whereby during casting the molten metal is essentially prevented from entering the relieved portion of said mold stool and said metal particles do not significantly comingle with said molten metal during casting, and whereby said metal particles sinter together to at least partially fill said relieved portion.

2. The method of claim 1 wherein said metal particles are of nonuniform size.

3. The method of claim 1 wherein said plate is metal.

4. The method of claim 1 wherein said metal particles are steel.

5. The method of claim 3 wherein said plate has a specific gravity at least equal to that of the metal being cast.

* * * * *